US005605141A

United States Patent [19]

Bilotta

[11] Patent Number: 5,605,141

[45] Date of Patent: Feb. 25, 1997

[54] MAKING NON-VERTICAL PLANAR CUTS IN MASONRY SLABS

[76] Inventor: Alessandro Bilotta, Via Matteo Bartoli 137, 00143 Rome, Italy

[21] Appl. No.: 221,419

[22] Filed: Mar. 31, 1994

[51] Int. Cl.[6] ..... B28D 1/08

[52] U.S. Cl. ..... 125/16.02; 125/21

[58] Field of Search ..... 125/21, 23.01, 125/16.01, 16.02, 16.04, 17, 19; 83/657.1, 167, 178

[56] References Cited

U.S. PATENT DOCUMENTS

| | | | |
|---|---|---|---|
| 2,795,222 | 6/1957 | Garrison | 125/21 |
| 2,803,239 | 8/1957 | D'avaucourt | 125/21 |
| 2,951,475 | 9/1960 | Leo | 125/16.01 |
| 2,958,323 | 11/1960 | Knoph et al. | 125/21 |
| 2,982,280 | 5/1961 | Wayland et al. | 125/21 |
| 3,957,028 | 5/1976 | Lesiourd et al. | 125/16.01 |
| 4,373,265 | 2/1983 | Van Halderan | 30/383 |
| 4,436,078 | 3/1984 | Bourke | 125/13 R |
| 5,056,272 | 10/1991 | Battaglia | 51/283 R |
| 5,226,402 | 7/1993 | Marocco | 125/23.01 |
| 5,243,960 | 9/1993 | Myles | 125/21 |
| 5,303,689 | 4/1994 | Mayer | 125/21 |

FOREIGN PATENT DOCUMENTS

0191455A1 8/1986 European Pat. Off. .

OTHER PUBLICATIONS

Product brochure "Diamantfil DF 2000", Pellegrini Meccanica s.p.a., Verona, Italy (undated).

Product brochure "Monofilo Diamantato 4000/21", Michele Fazion Officine Meccaniche, Verona, Italy (undated).

Product brochure "Pellegrini 'the stone master' The Group", Pellegrini Meccanica s.p.a., Verona, Italy (undated).

Product brochure "Pellegrini 'the stone master' Robot Wire", Pellegrini Meccanica s.p.a., Verona, Italy (undated).

Product brochure "Truco Diamond Bits, Blades, Wire, Equipment and Accessories", Truco Construction Products, Jul. 1992, No. CS20M, Columbia, South Carolina.

*Primary Examiner*—Timothy V. Eley
*Attorney, Agent, or Firm*—Fish & Richardson P.C.

[57] ABSTRACT

A non-vertical planar cut is made from one edge of a slab, through the slab, to an opposite edge of the slab by providing a moving cutting wire held in the plane of the cut and by moving the slab and the cutting wire toward one another until the cut has been completed. Alternatively, the slab is cut by a rotating cutting disk with a diameter aligned with an edge of the slab in the plane of the cut. The slab is held generally vertically during cutting, and a spacer is inserted into the cut for support before the cut is completed.

31 Claims, 17 Drawing Sheets

MAKING NON-VERTICAL PLANAR CUTS IN MASONRY SLABS

BACKGROUND

This invention relates to stone laminated panels.

Some decorative stone laminated panels, for example, lightweight marble paneling available from Stone Panels Incorporated of Texas, consist of a thin stone slab (e.g. 1 cm thick) glued onto an aluminum honeycomb backing (e.g. 2 cm thick).

Thin laminated stone paneling is typically made with a cutting machine designed for squaring off large marble blocks, for example, the Diamantfil DF 2000 model, available from Pellegrini Corporation in Verona, Italy.

Originally, stone cutting machines were designed to cut marble blocks a meter or two on each side using a loop of diamond impregnated wire supported by two aligned pulleys, each about 2.5 meters in diameter. The section of wire between the two pulleys is held horizontally under a high tension adjusted by a 4.5 m long lever arm. The pulleys are lowered to bring the wire into contact with an upper surface of a stationary marble block. As the pulleys rotate and continue to move down, the wire abrades the marble, making a vertical cut across the full width of the block and eventually down through the full height of the block.

When used in making thin laminated stone panels, the block cutting machine produces two stone panels from a sandwich consisting of a thin marble slab (e.g. 3 cm thick) with an aluminum honeycomb (e.g. 2 cm thick) glued on each flat surface of the slab. For cutting, the sandwich is mounted upright on one of its edges, with the opposite edge of the slab held parallel to and directly underneath the horizontal diamond wire and the honeycombs aligned with and on either side of the wire. As the wire is lowered onto the slab with the pulleys rotating, the sandwich is sliced into two marble laminated panels, each having an approximately 1.0 cm thick marble slab glued to an aluminum honeycomb backing.

Other marble block cutting machines available from Pellegrini, for example the RW 1600, move a marble block against a loop of wire supported by two pulleys each with a rotatable axis. The pulleys can be adjusted to hold the loop of wire at a variety of angles to produce an inclined cut against the side of the marble block. The Space Wire, also available from Pellegrini, supports marble blocks on a rotating table. Pulleys holding the loop of wire are mounted on a lever arm that positions the wire against the marble block over a range of angles.

Other machines (available as the "Scoppiatrice orrizontale" from Socomac in Verona, Italy; and the LT 4D/460 and LT 6D/600 from Levi Tunisi in Milan, Italy) have two horizontal disk saws arranged to split a flat slab into two thinner slabs. A horizontal cut is made along the slab as it is moved against the disk saws by a conveyor belt supporting the slab. A metal sheet inserted into the cut prevents an upper portion of the cut slab from collapsing onto a lower portion. The machines are able to cut slabs with a width no larger than 60 cm (at a typical 3 cm thickness).

Large thin slabs may also be split in two while held vertically in a machine described by Bourke (U.S. Pat. No. 4,436,078). The slabs are held upright by suction cups on a table which moves the slabs against a large, vertical disk saw which cuts through half the height of each slab. Each slab is then flipped to allow the saw to cut the other way through the slab and thus split the slab in two.

SUMMARY

In general, in one aspect, the invention features making a non-vertical planar cut from one edge of a slab of masonry material, through the slab, to an opposite edge of the slab, by providing a moving cutting wire held in a non-vertical plane of the cut, providing the slab with one edge facing the cutting wire, and moving the slab and the cutting wire toward one another until the cut has been completed.

Embodiments of the invention may include the following features. The slab may comprise a stone slab with a backing disposed on each face of the slab. The cutting wire may be held horizontally in the plane of the cut. The slab may be mounted on a support and pressure may be applied on the slab to hold the slab against the support while it is moved against the cutting wire. Successive slabs may be cut consecutively essentially without delay. Alternatively, the cutting wire may be moved against the slab. An inflatable seal may be inserted inside the cut and then inflated. The slab may be supported on a table, and a pin may be inserted in a hole in a top surface of the table to support the slab against the cutting wire.

In general, in another aspect, the invention features making a non-vertical planar cut from one edge of a slab of masonry material, through the slab, to an opposite edge of the slab with a loop of cutting wire. A segment of the cutting wire with a length spanning a width of the slab is held in the plane of the cut. Two pulleys respectively support opposite ends of the cutting wire segment. A rigid element, positioned above the cutting wire segment but below an opposite segment of the loop of cutting wire, respectively applies opposing forces on the two pulleys.

Embodiments of the invention may include the following features. The slab may comprise a stone slab having a backing disposed on each face of the slab. The two pulleys may be vertical. Each pulley may be made adjustable in height. Two smaller horizontal pulleys may lie in the plane of the cut to support the cutting wire segment at both ends of the segment. The two smaller pulleys may be fixed in the plane of the cut but may be made adjustable along the direction of the width of the stone slab.

The rigid element may have a hydraulic mechanism maintaining a desired level of tension on the cutting wire. A table may support the stone slab and move along a rail extending under the cutting wire segment. The table may have a back edge supporting the stone slab that may be short enough to pass under the cutting wire, or may instead be a pin inserted in a hole in the top surface of the table. The pin may be rigid but soft enough to be sliced by the cutting wire. A rotating spur gear may lock onto a rack on the lower surface of the table and move the table along the rail.

A conveyor belt may support the slab and may move the slab against the cutting wire. A pressure element may press the slab against the conveyor belt while the belt carries the slab.

In general, in another aspect, the invention features a panel having an unfinished stone slab laminated to a backing with a panel thickness uniform to within 1 millimeter.

Embodiments of the invention may include the following features. The backing may be a plastic honeycomb backing and the stone slab may be less than 2 millimeters thick.

In general, in yet another aspect, the invention features a panel having a stone slab laminated to a plastic honeycomb backing.

In general, in still another aspect, the invention features a panel having a stone slab laminated to a water resistant particle board backing or to a plastic honeycomb backing.

In general, in another aspect, the invention features a panel having a thin stone slab less than 2 millimeters thick laminated to a backing.

In general, in another aspect, the invention features making a planar cut from one edge of a slab of masonry material, through the slab, to an opposite edge of the slab by placing the slab on a generally planar support. A first bracket applies pressure against a surface of the slab and a second bracket applies an opposite pressure against an opposite surface of the slab to hold the slab transversely to the plane of the support. Each bracket is mounted on the support. The slab moves relative to least one rotating cutting disk in direction toward the disk until the cut has been completed. The disk has a diameter aligned with an edge of the slab in the plane of the cut. A spacer is inserted into the cut to support each side of the cut respectively against the first bracket and the second bracket.

Embodiments of the invention may include the following features. The spacer may be a metal T-shape and the support may be disposed horizontally and the slab may be held vertically. A hydraulic pump mechanism may adjust a position of the second bracket in the plane of the support.

A set of parallel slabs may be held between the first and second brackets, the first bracket applying pressure against a side surface of a first slab in the set, the second bracket applying an opposite pressure against an opposite side surface of a last slab in the set. The set of slabs may move relative to a set of parallel rotating cutting disks, each disk being aligned with an edge of a corresponding slab in the set of slabs and each disk being held in a plane of a cut made in the corresponding slab. At least one polishing disk may also be held in a plane of the cut and aligned with an edge of the slab behind the cutting disks. The polishing disk and the slab may move toward one another after the cut has been completed, the polishing disk fitting inside the cut to polish an inner surface of the slab. A second polishing disk with a finer abrasive surface disposed behind the first polishing disk may further polish the slab.

The spacer may be inserted inside a first cut, before rotating the slab in the plane of the cut to move the support away from the cutting disk. The disk and the slab may then move toward one another until a second cut has been completed, the first cut and the second cut joining together to form the planar cut through the slab.

Among the advantages of the invention are the following.

Unlike unlaminated thin marble slabs, which are too brittle to be machined, the laminated panels are both machinable and sturdy. The strong and lightweight panels may be used in kitchen cabinets, counters and tables. The marble panels are also particularly useful in decorating weight-sensitive structures, such as elevators, boats and building facings.

The cutting machines described above are small, light, easily set-up, and inexpensive. The machines produce panels cut from a single stone sandwich with a much more uniform thickness than those created by existing techniques. In the case where the slab is held horizontally, the slab need only be aligned in two directions: a top surface of the table or belt supporting the sandwich must be adjusted to align the slab with the cutting wire, and the cutting wire must be aligned with the slab. Both these adjustments are easily made and maintained by the table (or belt) and pulleys holding the wire which have a fixed height and angle during cutting. In the case where the slab is held vertically, the brackets and cutting disks are precisely aligned to ensure a uniform cut.

The extreme uniformity of marble thickness in the laminated panels allows the machines to produce panels having an extremely thin (and thus very lightweight) stone layer without relying on grinding and polishing the stone to reduce its thickness. With a thin stone slab in the sandwich, panels with stone facings only two millimeters thick are obtained.

The machines also allow a large number of panels to be produced from a small block of marble or granite. As a result, the panels are highly uniform in color and patterning, which is valuable in decorative applications.

In addition, every pair of laminated panels formed from a single stone sandwich is easily "bookmatched", or mounted side by side to display a symmetrical vein pattern in the marble. Each panel has only one exposed stone surface that is automatically bookmatched to the stone surface of the second panel cut from the same stone sandwich. As a result, there is no need to keep track of which surface of the panel needs to be polished. Stone slabs split from a block, by contrast, have two stone surfaces only one of which is bookmatched to a second slab split from the same block. A manufacturer must therefore mark the surface of each slab to be polished and track pairs of bookmatched slabs. The invention avoids this type of costly inventory system by pairing together bookmatched panels by simply stacking them in the order in which they are cut.

Other advantages and features of the invention will become apparent from the following description and from the claims.

DESCRIPTION

Figure 16:
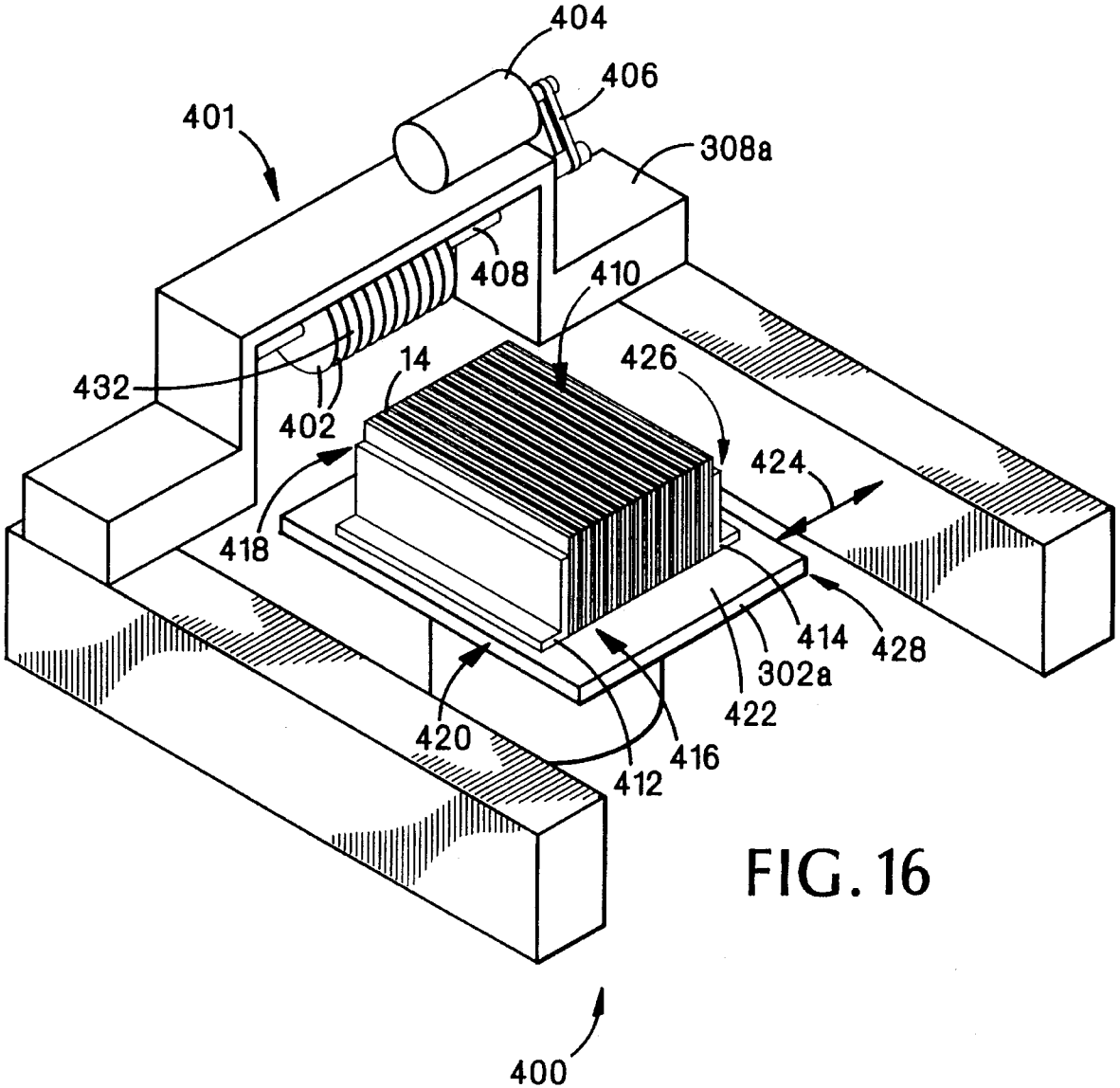
FIG. 16 is a perspective schematic view of a small stone sandwich cutting machine.
Figure 17:
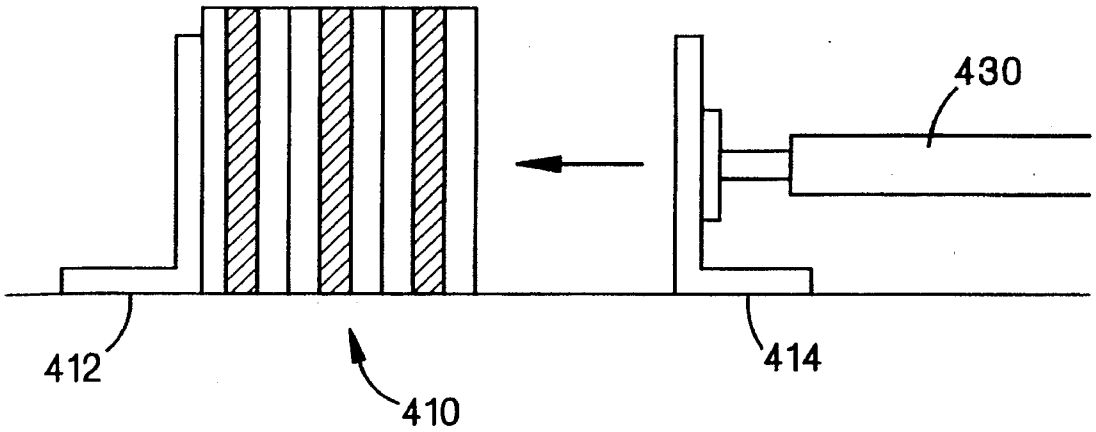
FIGS. 17 and 18 are perspective and side schematic views, respectively, of a portion of the cutting machine of FIG. 16.
Figure 18:
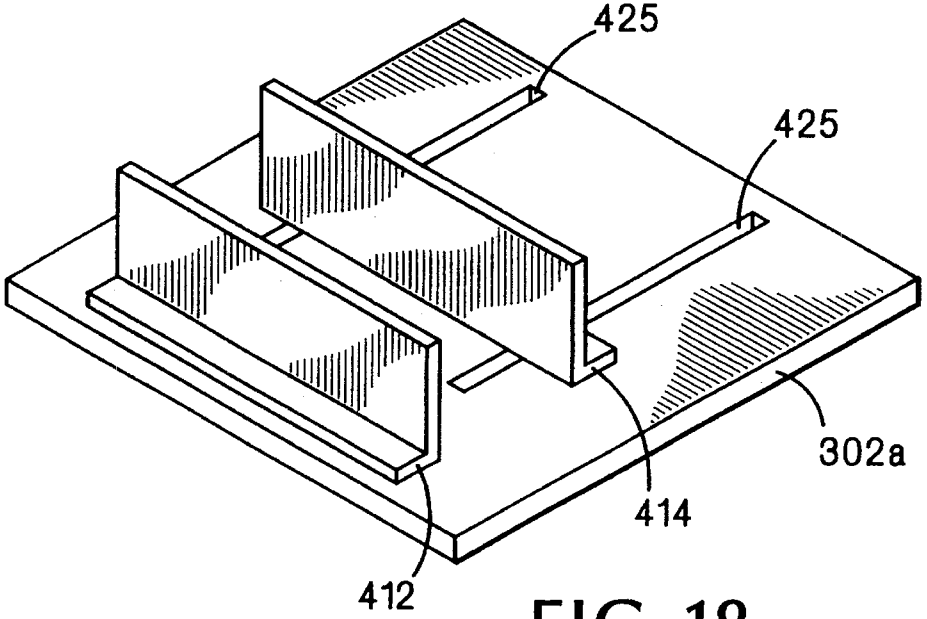
Figure 19B:
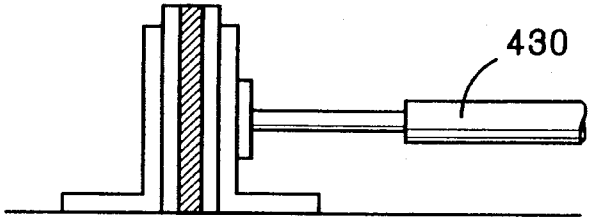
Figure 19D:
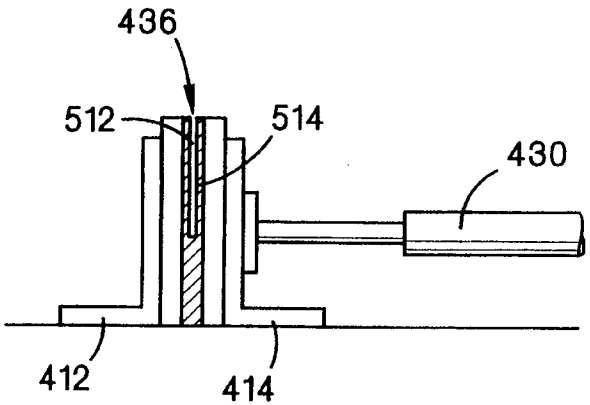
Figure 19A:
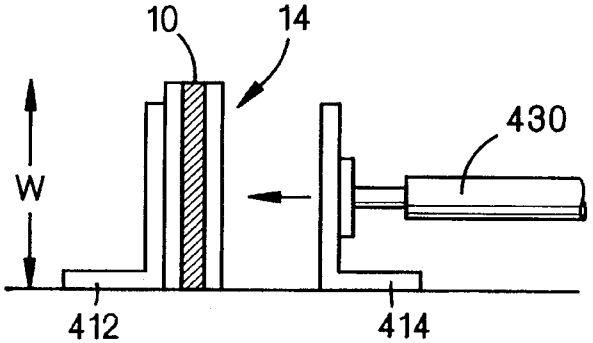
Figure 19C:
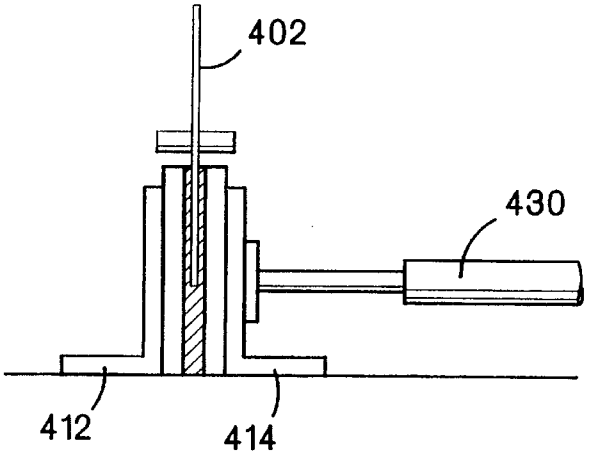
Figure 19E:
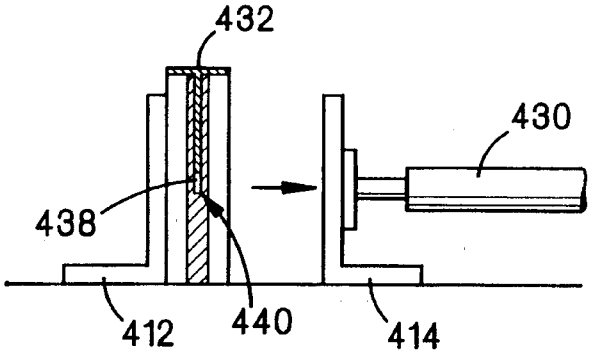
Figure 19F:
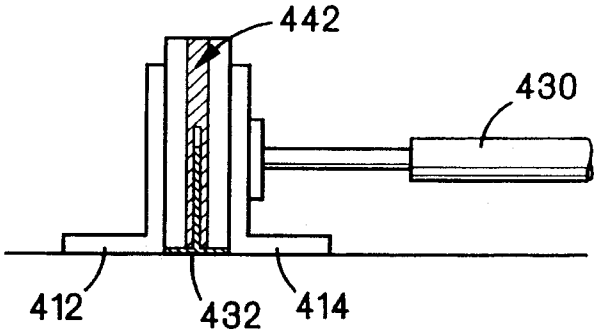
Figure 19G:
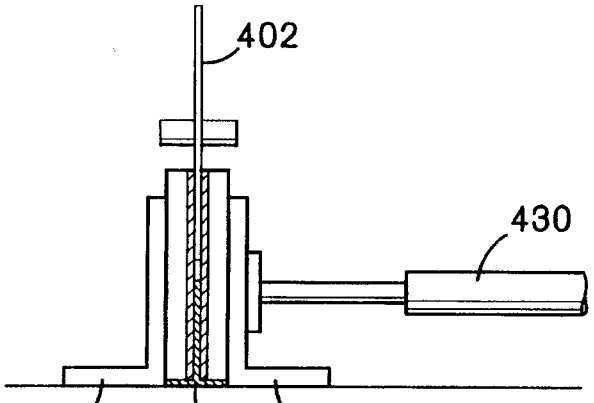
Figure 19H:
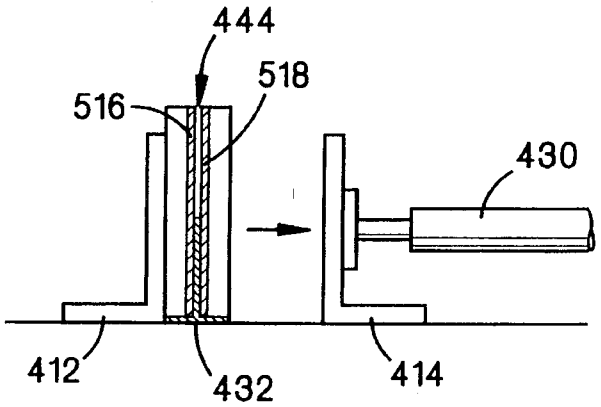

FIGS. 19*a* through 19*h* are side schematic views of a stone sandwich as it is being cut by the machine of FIG. 16.

Figure 20:
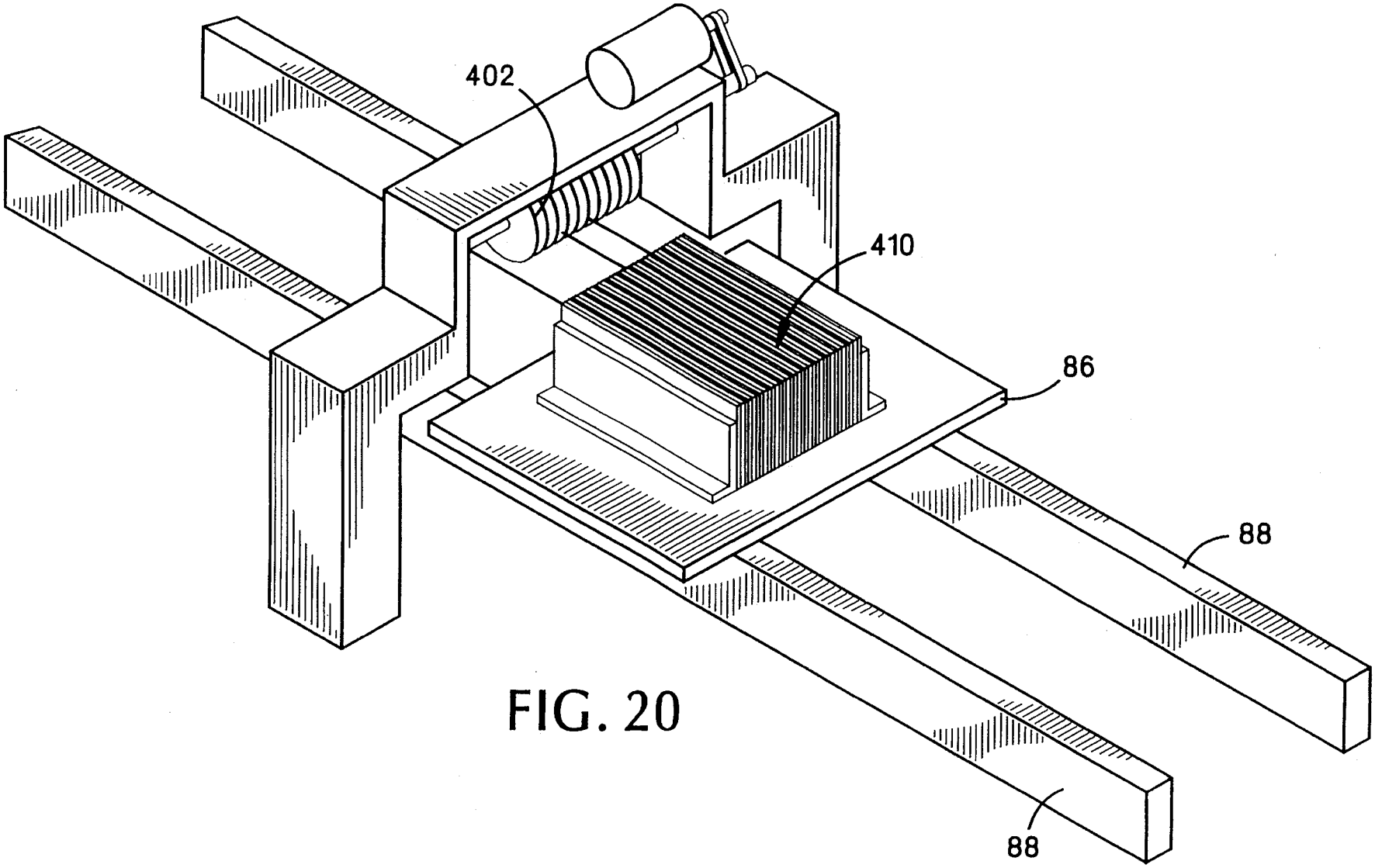

FIG. 20 is a perspective schematic view of another small stone sandwich cutting machine.

Figure 21:
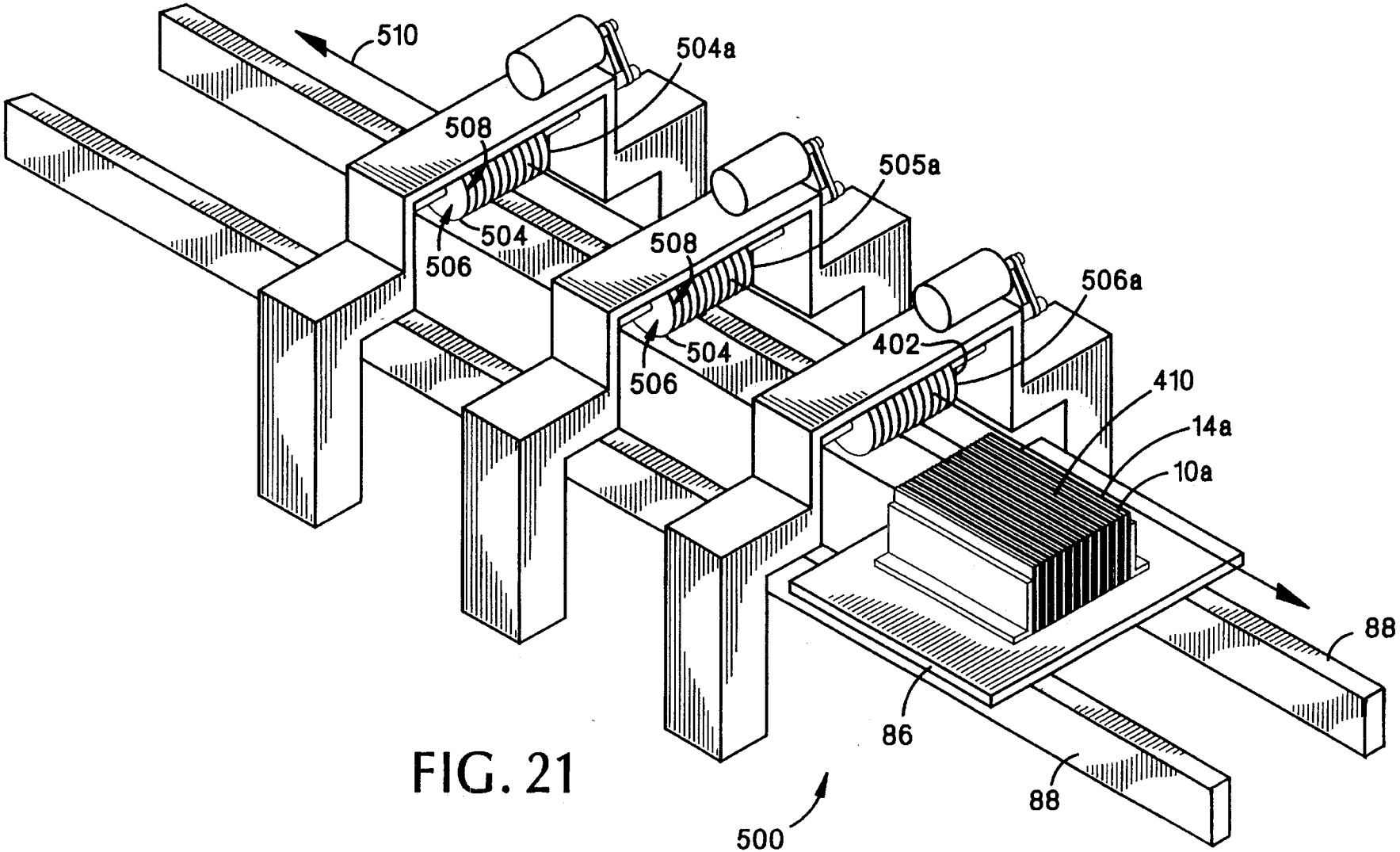

FIG. 21 is a perspective schematic view of a cutting and polishing machine.

Figure 22:
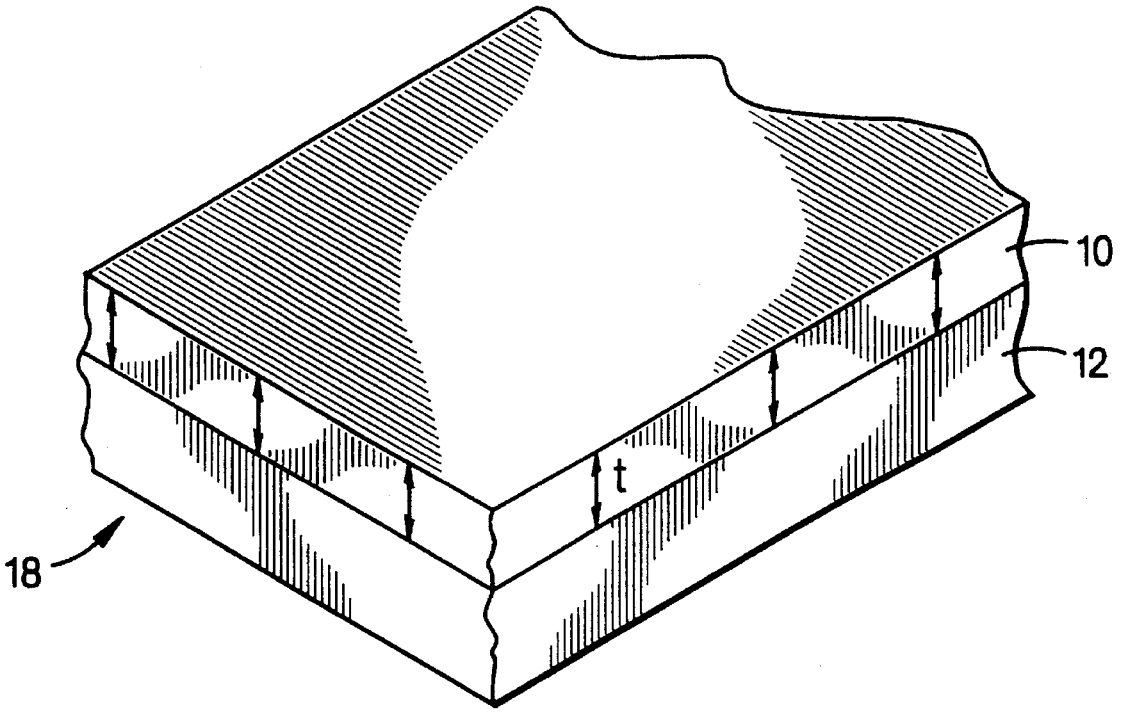

FIG. 22 is a schematic perspective of a stone laminated panel.

Figure 23:
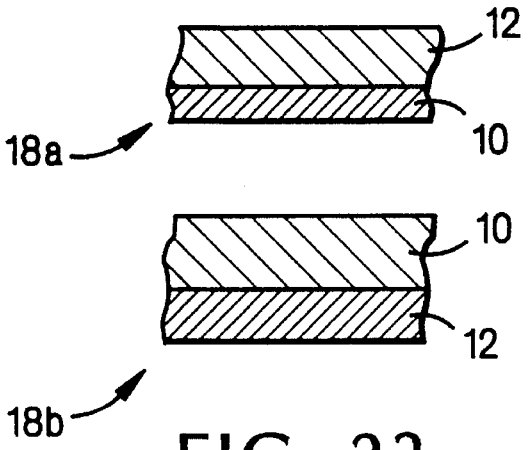

FIG. 23 is a schematic front view of two stone laminated panels cut from a single sandwich.

Figure 1:
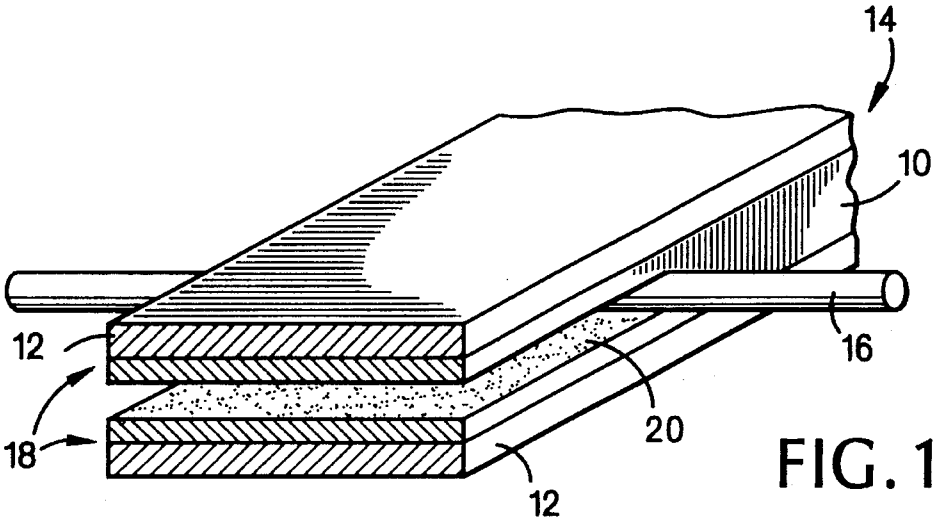
FIG. 1 is a perspective schematic view of a sandwich being split to form a stone laminated panel.

Referring to FIG. 1, the process begins with a 2 cm thick, 10 feet by 5 feet stone slab 10, such as marble or granite. A 2 cm thick backing 12 is glued on each face of the slab with a press (not shown) to form a stone sandwich 14.

The backing is a material that is light, water resistant, and strong, for example a water resistant and flame resistant particle board available from SIT Corporation in Italy. Alternatively, the backing is a plastic honeycomb, for example a Norcore plastic honeycomb number 3, available from Norfield Corporation in Danbury, Conn.

The stone sandwich is held horizontally and slid against a 1 cm thick horizontal diamond impregnated cutting wire 16. The wire cuts the sandwich into two identical stone panels 18, each having a 0.5 cm thick marble slab supported by a backing 18. After the two panels are separated, the exposed grainy surface 20 of each panel is finished (e.g. polished, bush-hammered, flamed or honed) to smooth and shine the stone surface.

Figure 2:
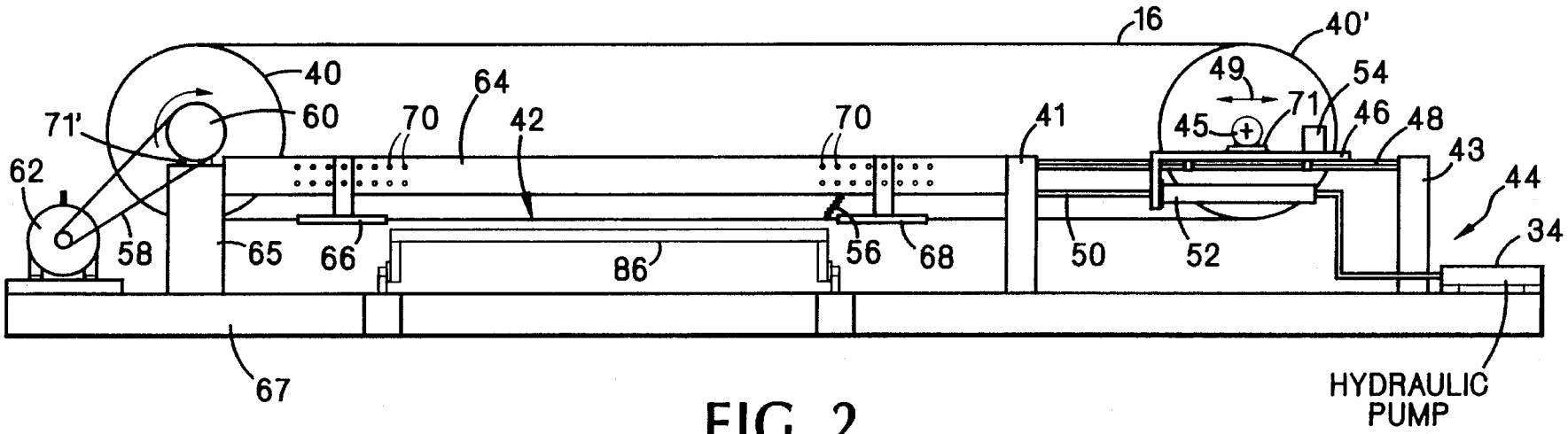
FIGS. 2 and 3A are front and top schematic views, respectively, of a cutting machine.
Figure 3A:
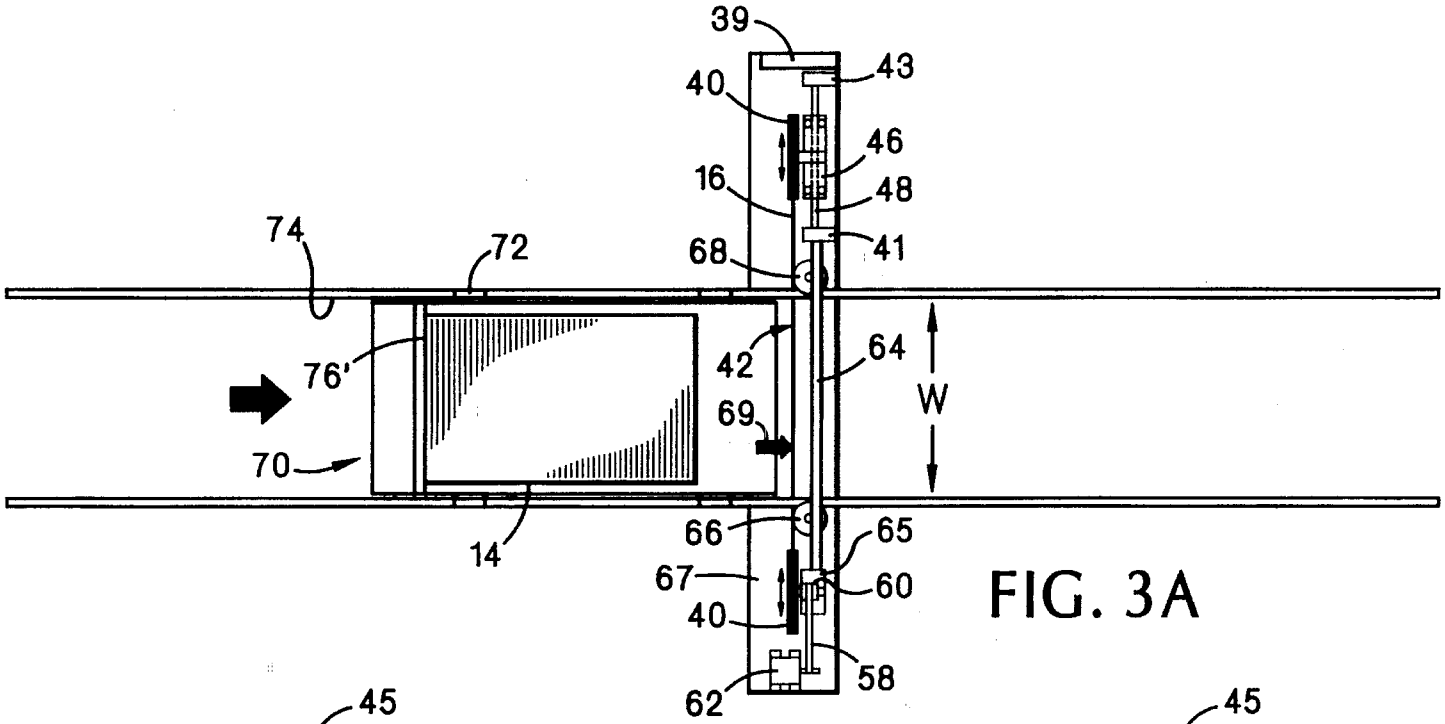

Referring to FIGS. 2 and 3A, the cutting wire is a loop of steel cable bearing a series of diamond impregnated beads (not shown), available from Truco Construction Products in Columbia, S.C. The wire is supported by two pulleys 40, 40' held under high tension (about 300 to 400 kilograms) so that the wire is straight and taut in its horizontal section 42.

The tension in the wire is adjusted by a hydraulic pump mechanism 44 that makes changes 49 in the horizontal position of pulley 40'. The bearing 45 which supports pulley 40' is attached to a platform 46 which is free to slide back and forth along a track 48 in response to a motion of a plunger 50 in hydraulic cylinder 52. Track 48 is mounted at its ends on two stationary supports 41, 43. The cylinder 52 attached to platform 46 and the plunger 50 attached to support 41 cooperate in response to hydraulic pressure from a pump 39 to move the platform to, e.g., a position at which a desired tension on the wire has been achieved. This may be done manually based on a tension gauge 54. The plunger has a maximum stroke of 24 inches and responds to a pulling force of 1500 lbs.

A water nozzle 56 continually douses the stone sandwich as it is cut to remove excess heat. The nozzle may direct water either on the wire or on the cut in the stone itself. For this reason, all materials used in the stone sandwich, including the glue holding the backings against the slab, are water resistant.

Pulleys 40, 40' are each 80 cm in diameter; pulley 40 is rotated (at its outer edge) by a belt 58 connecting a pulley 60 to motor 62. The motor may have a mechanically or electrically variable speed, or may rotate the pulley at a constant rate of 900 rpm, or approximately 80 miles an hour. Pulley 40' is free to rotate and match its speed to the driven pulley 40.

Supports 41, 43, and 65 are all mounted on a base 67. A square tubular steel piece 64 is mounted between supports 41 and 65, and holds two smaller pulleys 66, 68 each 30 cm in diameter, in horizontal fixed positions. The smaller pulleys support the lower horizontal section 42 of the cutting wire against the force 69 (FIG. 3) applied horizontally to section 42 as each sandwich is being cut. The horizontal positions of the smaller pulleys are maintained by bolts held in an array of holes 70. The wire can thus accommodate a broad range of maximum slab widths W. Generally, the pulleys are positioned to provide only minimal clearance on either side of the particular sandwich being cut.

Figure 3C:
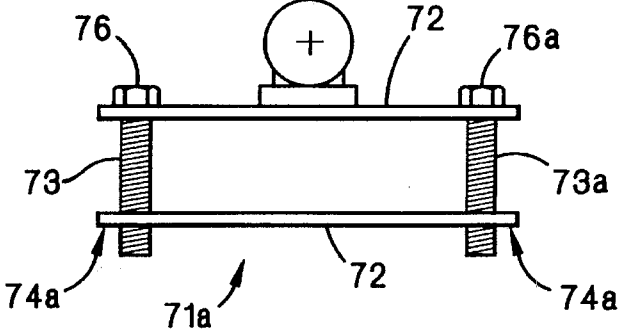
FIGS. 3B and 3C are side schematic views of a portion of the cutting machine of FIGS. 2 and 3*a*.
Figure 3B:
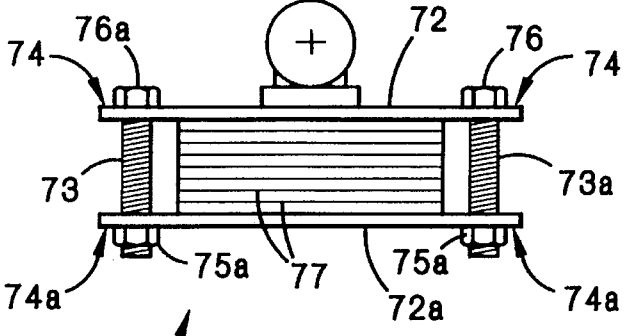

Referring to FIGS. 2 and 3B, bearing 45 of pulley 40' is welded to a horizontal metal upper face 72 of a support 71. A portion of a horizontal metal lower face **72*a* of the support is welded to rail 46, while a remaining portion of the lower face extends out from the rail. The upper face 72 and the lower face 72*a* of the support are connected by two vertical (approximately two inch long) screws 73, 73*a* passing through pairs of aligned holes 74, 74*a* in the upper face and the portion of the lower face extending out from rail 46, respectively. Nuts 75, 75*a* are threaded through the bottom ends of screws 73, 73*a* below the lower face of the support, while heads 76, 76*a* of screws 73, 73*a*, respectively, pass loosely through holes 74 in the upper face of the support. Aluminum sheets 77** stacked horizontally on the lower face up to the upper face of the support maintain a desired spacing between the upper face and lower face of the support.

Pulley 40' can be raised by loosening each nut 75, **75*a* to allow each screw to move freely in a vertical direction. A user then raises the bearing of the pulley by vertically lifting the attached upper face of the support and pulling along with it each screw. This creates a gap between the uppermost stacked aluminum sheet and the upper face of the support, into which the user slides additional, identical aluminum sheets horizontally onto the stack of sheets 77. The user continues adding aluminum sheets until a top sheet comes into contact with and supports the upper face of the support. The user then tightens nuts 75, 75*a*** to fix the screws holding the upper face of the support against the aluminum sheets firmly in place.

Similarly, the pulley can be lowered by loosening each nut, removing aluminum sheets from the support, and lowering the upper face of the support until it rests on the uppermost aluminum sheet stacked inside the support. Each nut is then tightened to hold the pulley at its new height. If greater height adjustments are needed (i.e. larger than around two inches), longer screws 73, **73*a*** can be used.

Bearing 60 of pulley 40 is similarly held by an upper face 72 of an identical support 71', with a lower face 73 partially welded to support 65 (FIG. 2).

Alternatively, as shown in FIG. 3C, nuts 74, **74*a* in each support 71, 71' are replaced by threading along the inside of holes 74*a* in the lower face 72*a* of the support 71*a*. The screws are supported by threading the screws 73, 73*a* into the holes in the lower face. Each screw thus maintains the desired spacing between the upper face 72 and the lower face of the support, replacing the aluminum sheets 77 of FIG. 3B. The height of each pulley is adjusted by turning the head 76, 76*a*** of each screw in the support to raise or lower the upper face of the support with respect to the lower face welded to the rail.

Figure 4:
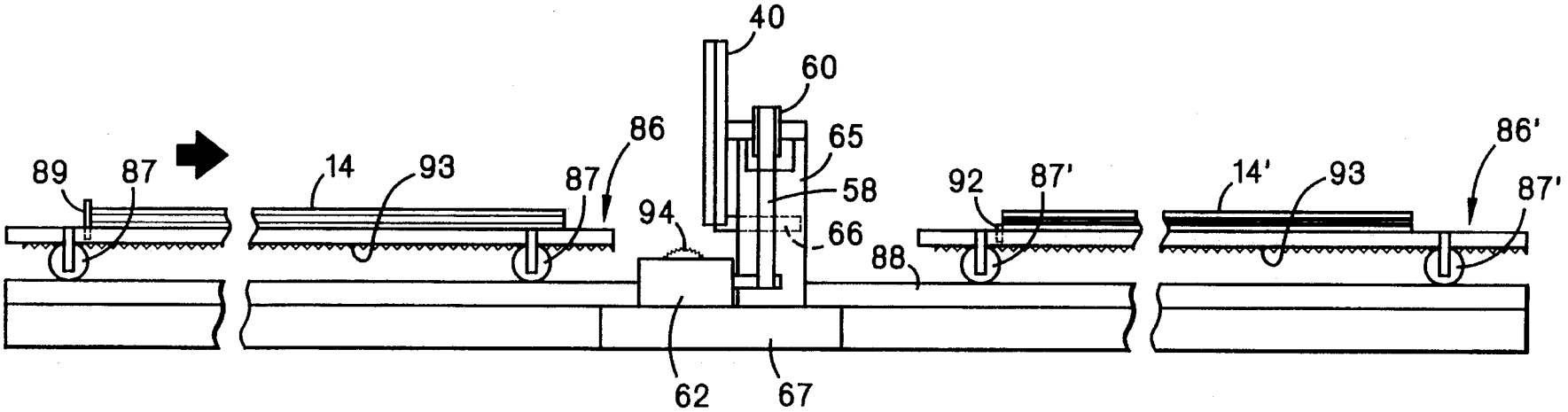
FIG. 4 is a side view of the cutting machine of FIGS. 2 and 3*a*.
Figure 5:
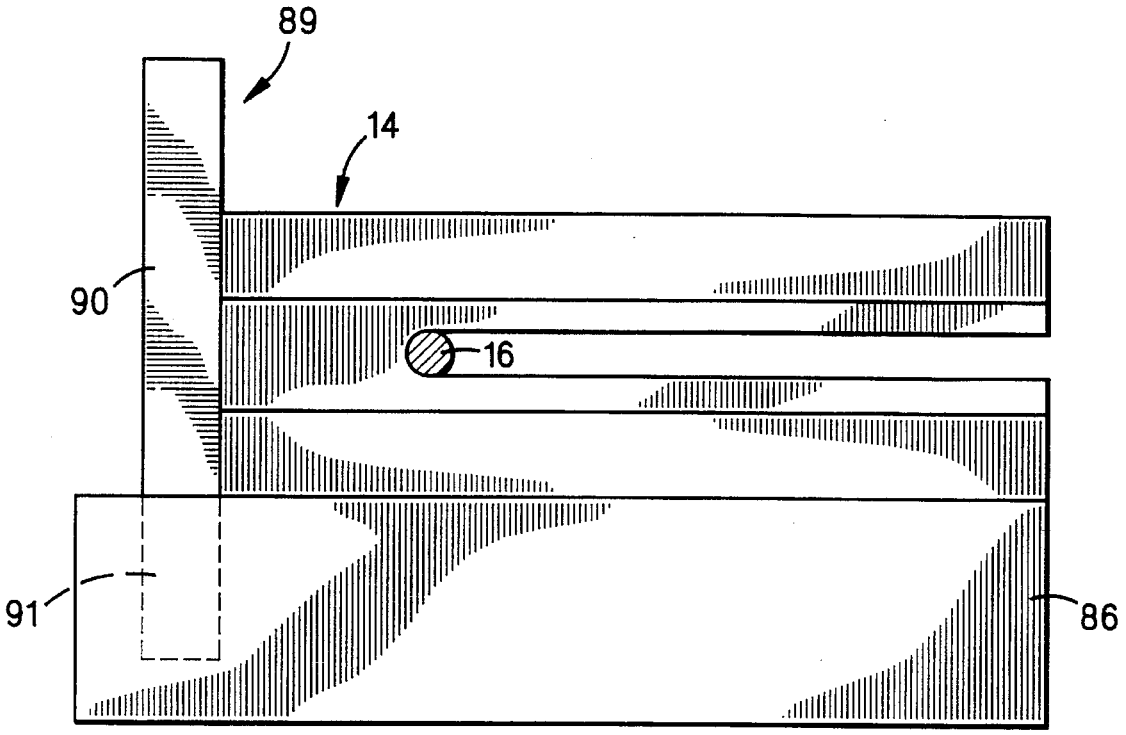
FIGS. 5 and 6 are schematic side views of a stone sandwich supported by a table.
Figure 6:
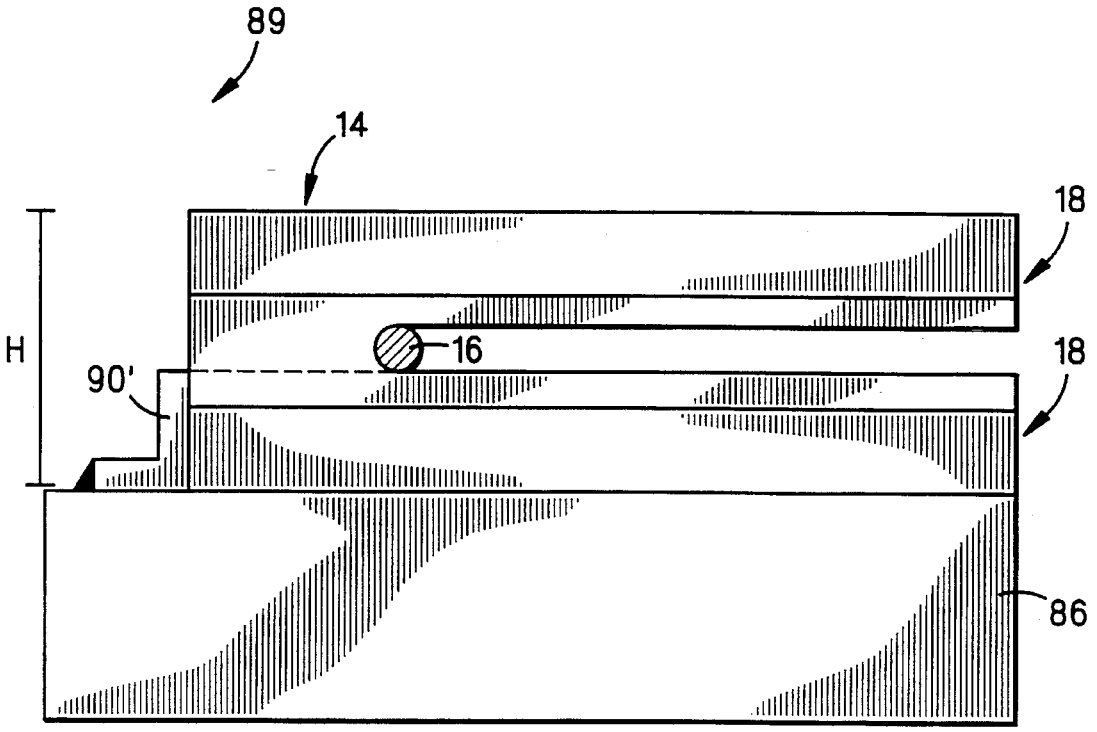

As shown in FIG. 4, each of the stone sandwiches 14, 14' is supported by a table 86, 86' with wheels 87, 87' following a rail 88 extending under the diamond cutting wire. Each sandwich is placed against an "edge" 89 extending up from the back of each table (FIG. 5) which supports the sandwich as it is pushed against the wire. In one implementation, the edge may be formed by a set of pins 90 that are inserted into corresponding holes 91 in the table. The pins are made of a rigid but soft material, such as a plastic, that can be easily cut by the diamond wire. After the stone sandwich has been cut in half, any remaining stubs 92 of pins 90 (FIG. 4) are removed from their holes, and a new set of pins is inserted in preparation for the next sandwich. Alternatively, as seen in FIG. 6, a short angle 90' is welded to the end of the table. The angle is lower than half the height H of the sandwich, allowing the wire to clear the angle after it has cut through the stone sandwich.

Figure 8:
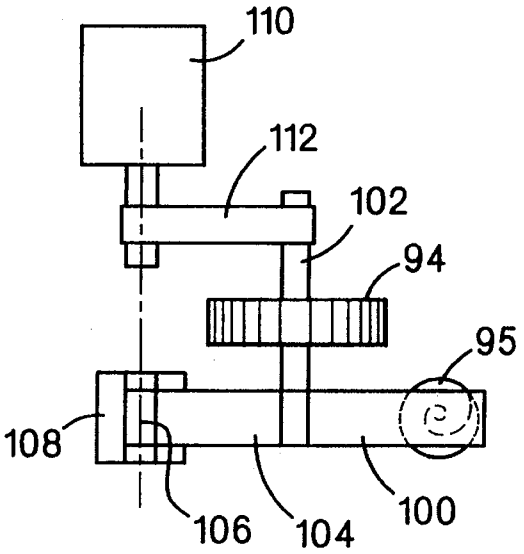
FIGS. 7 and 8 are schematic side and top views, respectively, of a table driving mechanism.
Figure 7:
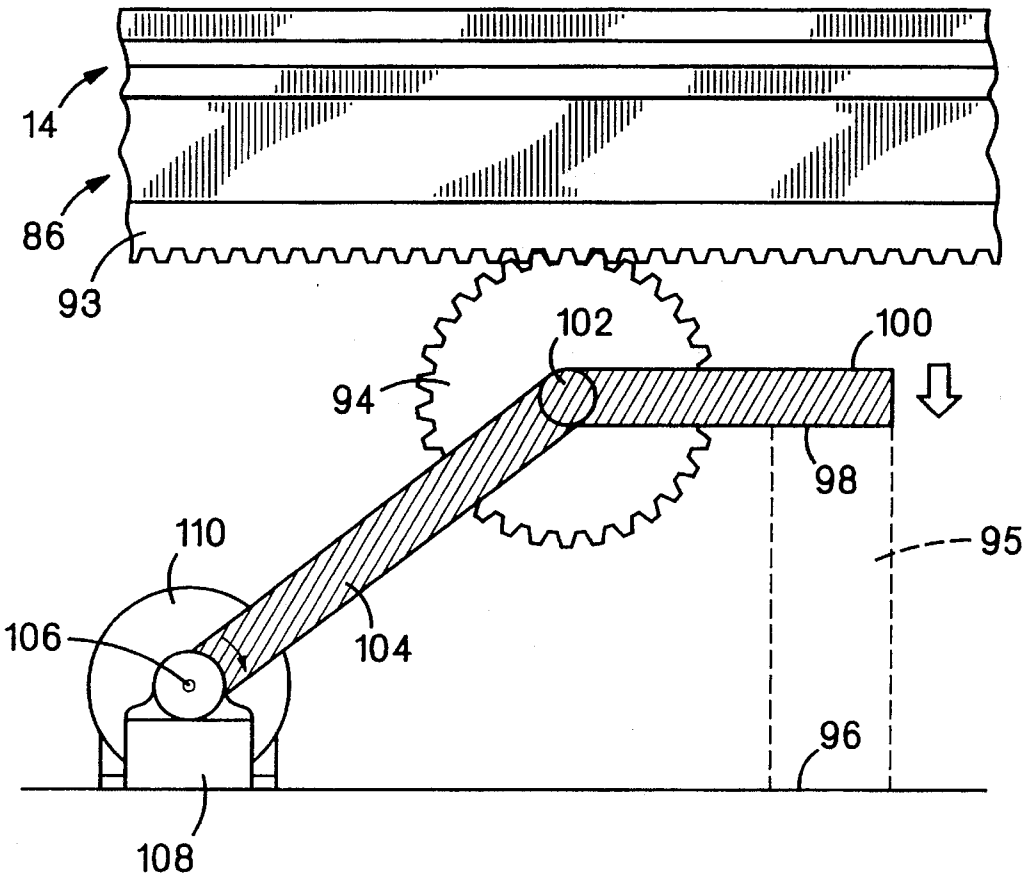

The tables move freely along the portions of the rail which are distant from the cutting wire. But when a table approaches the cutting wire a rack 93 (not seen in FIGS. 2 or 3) on the lower surface of the table is engaged by a matching spur gear 94 located just in front of the diamond cutting wire. The spur gear 94 drives the table under the diamond wire at a constant speed of about 1 to 2 inches per minute (or as fast as the sandwich being cut allows, e.g., harder stone must be cut more slowly than softer stone). Referring to FIGS. 7 and 8, the spur gear 94 is supported vertically by a spring 95 with enough force to hold the spur gear above the height of the rack in the absence of a table. One end 96 of the spring is attached to the ground, and another end 98 is attached to a lever 100 connected to an axis 102 of the spur gear. Alternatively, a plunger and cylinder in an engaged position are used to hold the spur gear firmly against the rack.

The shaft 102 of the spur gear is connected by a second lever 104 to a pivot point 106 held on the ground by a bearing support 108. The levers 100 and 104 are held fixed relative to one another. The shaft 102 of the spur gear 94 is steadily rotated by a motor 110 via a belt 112. When engaged with the rack, the rotation of the spur gear pushes the rack, and consequently the table, forward. During rotation, lever 104 keeps the shaft 102 at the same distance from the motor and thus keeps the belt at a constant tension. The spur gear is lowered manually after the sandwich is cut without having to turn off the motor.

Each table is made slightly longer than the corresponding stone sandwich (see FIG. 3), so that the spur gear is able to engage and push the table all the way through the cutting wire.

The height of the diamond wire is adjusted prior to cutting to ensure that the table surface and hence the stone slab inside the sandwich is level with the diamond wire, and thus to ensure that the thickness of each of the resulting laminated slabs is uniform (see FIGS. 3B and 3C). After the height of each pulley is adjusted, each pulley remains fixed during cutting.

Figure 9:
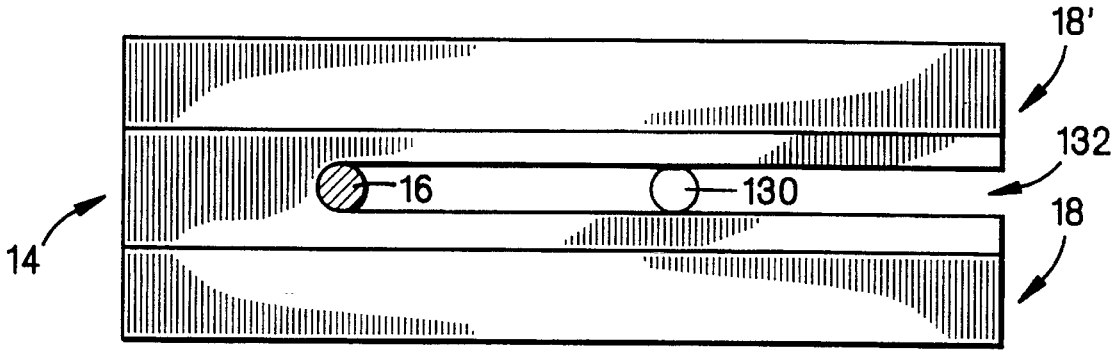
FIGS. 9 and 10 are schematic side views of a stone sandwich being cut.
Figure 10:
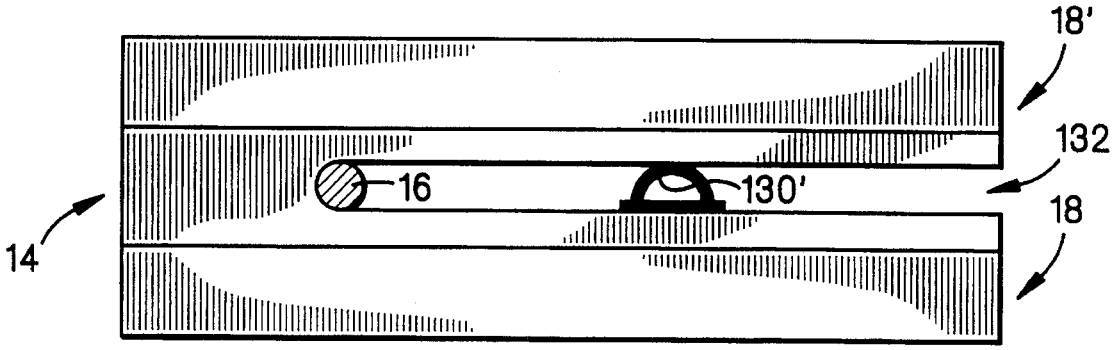

After the stone sandwich is partially cut, as shown in FIGS. 9 and 10, a spacer element 130, 130' is inserted in a gap 132 between the two panels 18, 18', to support the upper panel 18' and prevent it from collapsing onto the bottom panel 18 and possibly breaking. The spacer element is a steel rod 130 or, alternatively, an inflatable seal 130' that is initially flat and is pulled or threaded through the gap before inflation. Seals of this type are available from Presray Corporation, located in Pawling, N.Y. A spacer is inserted about every twenty minutes during the cutting process.

After the stone sandwich is sliced in half, the exposed grainy cut surface of the stone on both laminated stone panels 18 (FIG. 1) is polished. This reduces the thickness of the marble slab by 0.5 to 1 mm.

Figure 11:
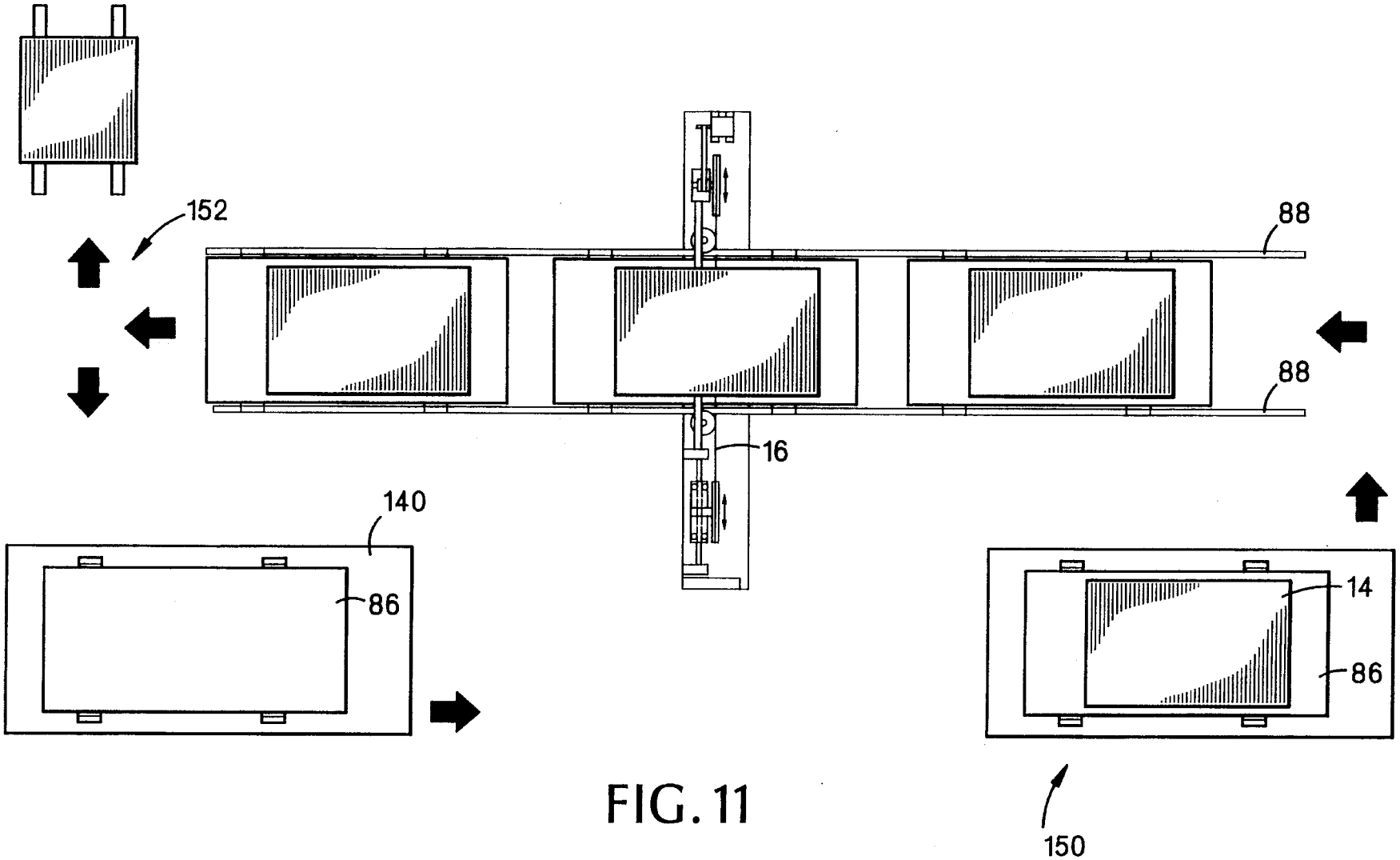
FIG. 11 is a schematic top view of a stone laminated panel production line.

In a production line of marble panels, shown in FIG. 11, an empty table 86 sitting on a dolly 140 is pushed to a loading zone 150 where an uncut stone sandwich 14 is placed on the table. The table is then pushed onto the rail 88 from a dolly, and then pushed by hand freely and quickly up to the diamond cutting wire, where the spur gear engages with the rack under the table. The spur gear drives the table through the rotating cutting wire 16 at a steady speed. After the sandwich is cut into two panels, the spur gear is disengaged, and the table is rolled freely to an unloading zone 152, where the cut panels are removed, polished, stacked and stored. The empty table is returned to the loading zone.

The marble cutting process is made efficient by disengaging the spur gear after a sandwich is cut and pushing the table out to the unloading zone at a higher speed. The next table in the production line is similarly moved up quickly to the point where the spur gear engages its rack, and is then moved slowly through the diamond wire. This minimizes the waiting time between cutting successive stone sandwiches.

Figure 12:
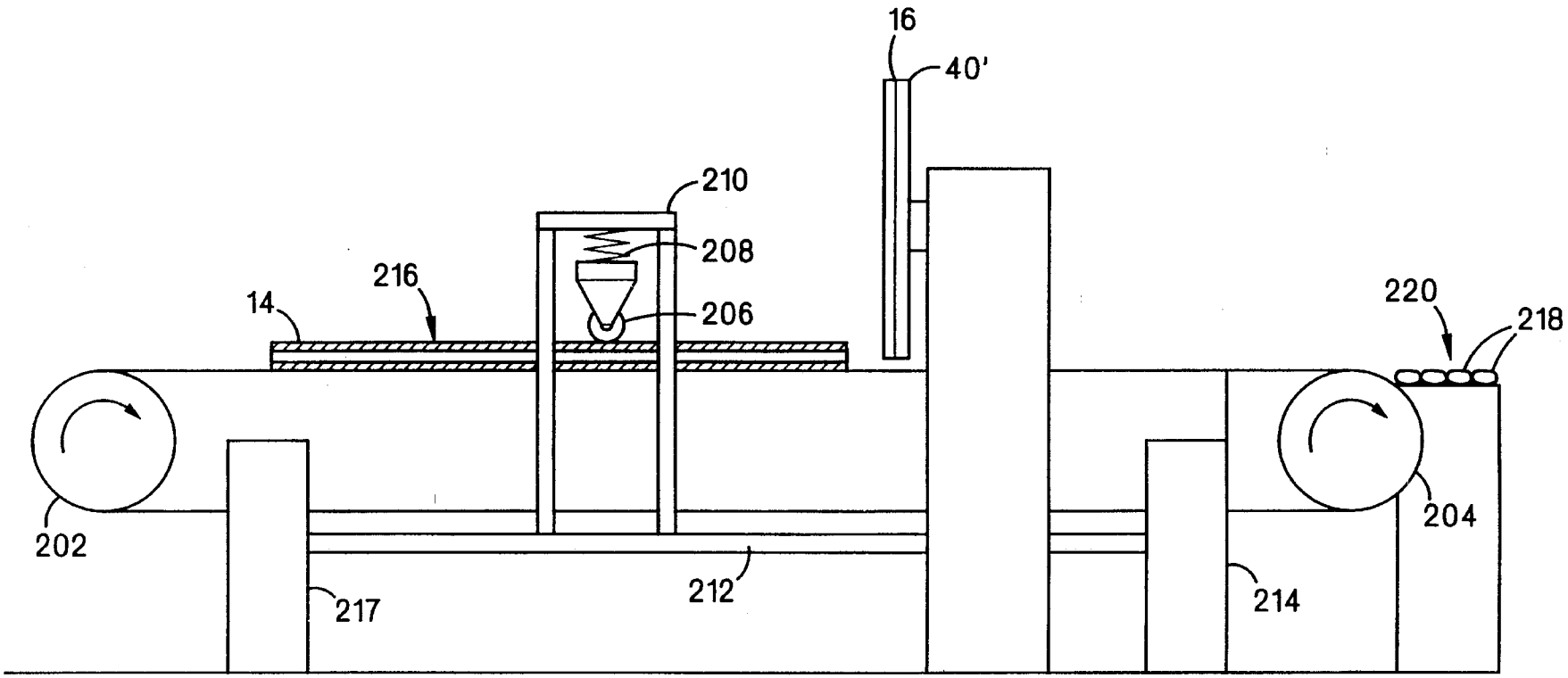
FIG. 12 is a side view of another cutting machine.

Referring to FIG. 12, table 86 (FIG. 11) supporting each stone sandwich may be replaced by a moving conveyor belt 200 supporting each sandwich 14 and moving each sandwich horizontally against the diamond cutting wire. The conveyor belt is wound around and moved by two rotating pulleys 202, 204 one of which is connected to a motor (not shown).

Each successive stone sandwich is held on the belt by a wheel 206 connected to one end of a vertical spring 208. An opposite end of the spring is attached to a metal frame 210 that is in turn supported by a platform 212 on base columns 214 of the machine. The wheel is adjusted to come into contact with a top surface of the sandwich on the belt. The wheel and spring together exert a vertical pressure on a top surface 216 to prevent each stone sandwich from slipping relative to the conveyor belt. At the same time, the wheel rolls over the top of the sandwich allowing the belt to freely move the sandwich against the cutting wire. After each stone sandwich is cut, metal rollers 218 unload the sandwich from the machine.

The conveyor belt is precisely aligned to maintain the top surface of each stone sandwich at a constant distance from the cutting wire to produce stone laminated panels with a uniform stone thickness. Advantages of the conveyor belt include its small size, uniform speed, and the ease with which the stone sandwiches are loaded onto the belt.

Figure 13:
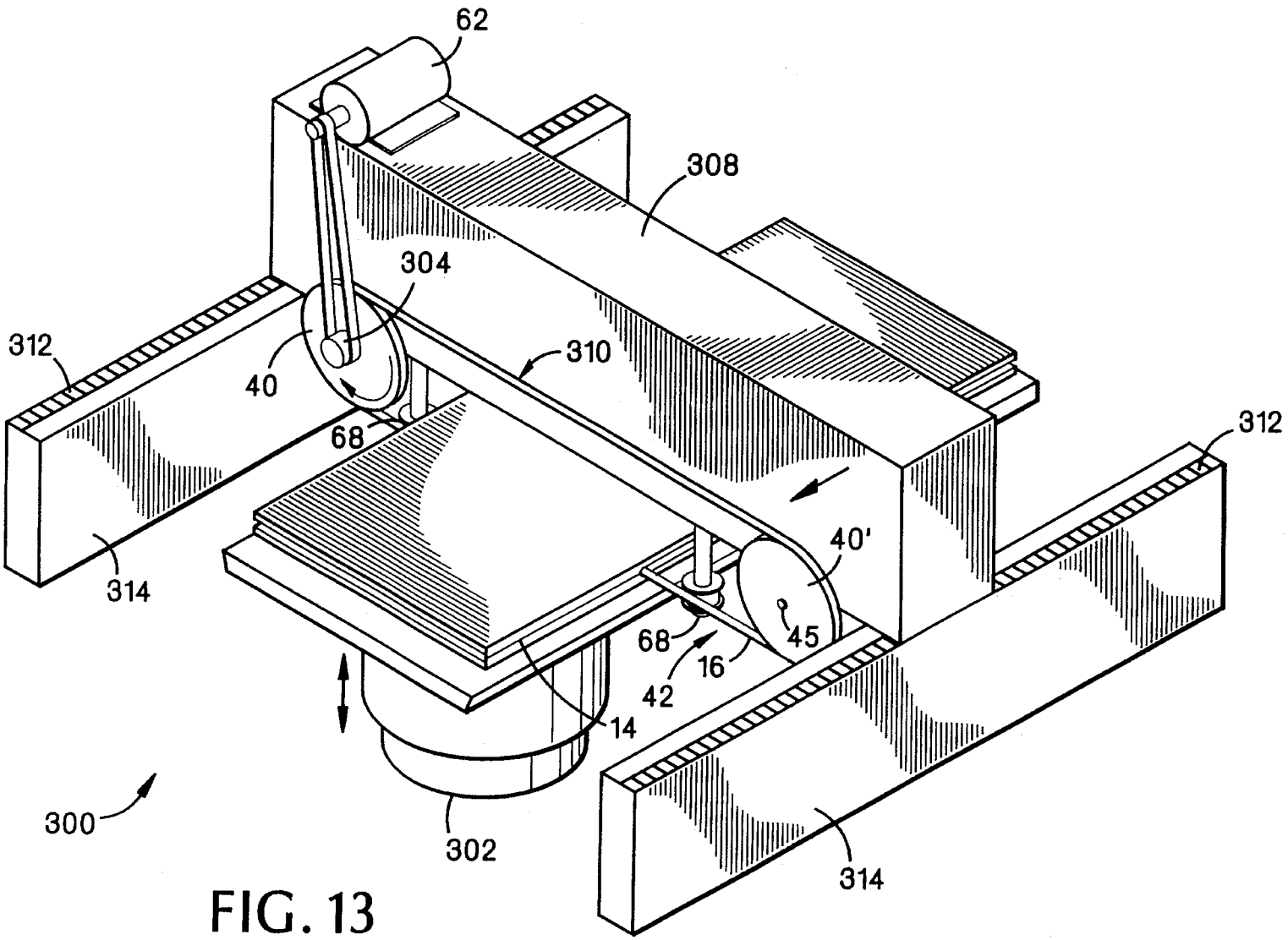
FIGS. 13, 14 and 15 are perspective, front and side schematic views, respectively, of another cutting machine.
Figure 14:
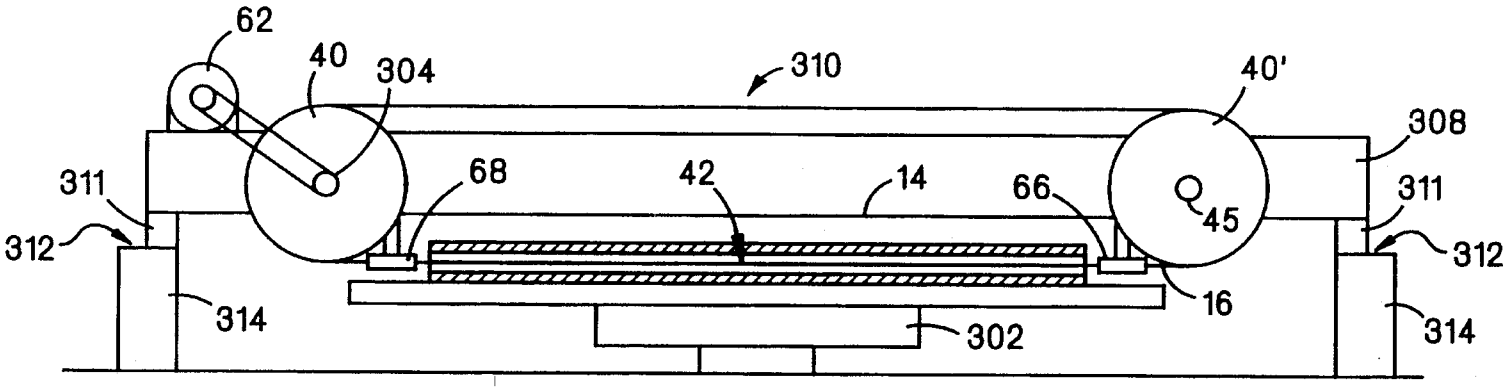
Figure 15:
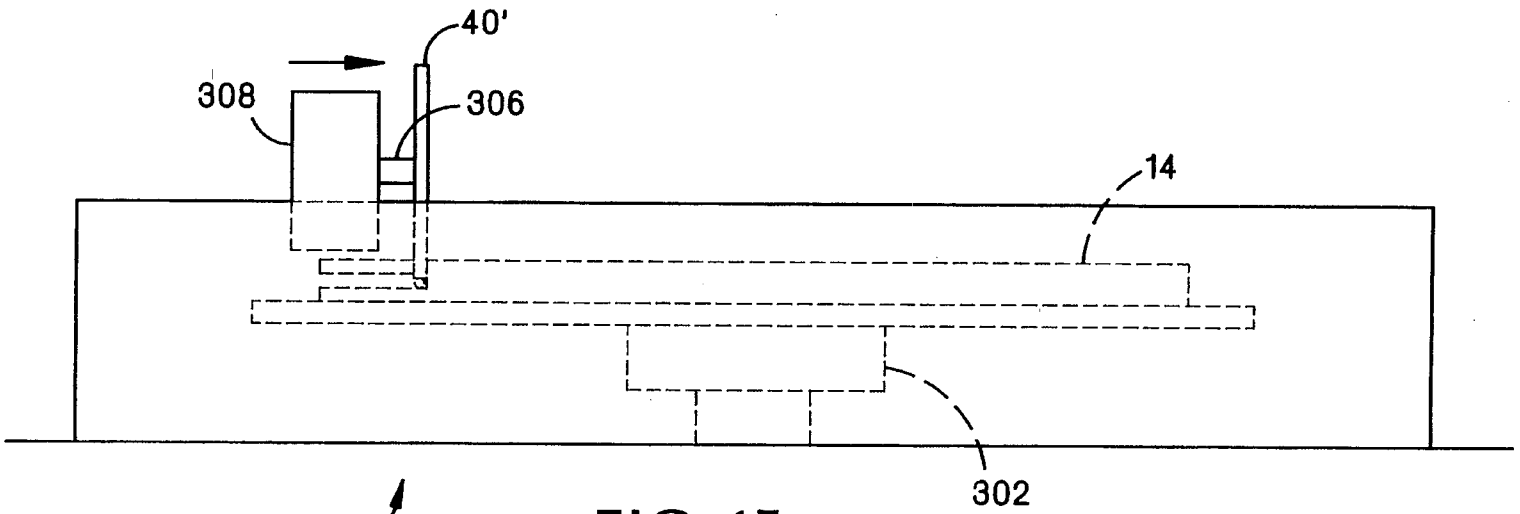

An alternative cutting machine 300, seen in FIGS. 13 through 15, has a vertically adjustable table 302 supporting each stone sandwich 14 against a diamond cutting wire 16 moving horizontally towards the sandwich. The table typically has a vertical hydraulic pump mechanism, similar to that described above in connection with FIG. 2, that precisely adjusts the height of the table. The diamond cutting wire is again supported and rotated by two large pulleys 40, 40' and two small pulleys 66, 68, in a manner analogous to that described above. Motor 62 rotates pulley 40' to cause the cutting wire to move and abrade the stone sandwich.

Bearings 45, 304 of pulleys 40', 40, respectively, are connected by a horizontal rod 306 to a bridge 308. Bridge 308 is located above lower section 42 of the cutting wire and below an upper section 310 of the cutting wire. The bridge is supported by wheels 311 under the bridge held in tracks 312 on each main support 314 of the machine. The bridge is moved horizontally by a motor (not shown) that propels wheels 311 along the tracks. The sandwich remains stationary on the table as the bridge moves the cutting wire against the sandwich.

Smaller stone laminated panels, e.g. up to one meter wide, may be cut by another cutting machine 400, shown in FIGS. 16 through 19. The machine has a horizontally movable bridge **308*a*, analogous to that described above in connection with FIG. 13, with an elevated central section 401 supporting several vertical coaxial cutting disks 402. Motor 404 rotates the disks with a belt 406 connected to axle 408** supporting the disks.

A set of stone sandwiches 410, each approximately 2 cm thick and up to one meter wide, stacked vertically along their length are held by brackets 412, 414 on a vertically adjustable table **302*a*. Bracket 412 holding one end 416 of the set of sandwiches is a metal angle welded to the table. An edge 418 of the bracket is exactly aligned with an edge 420 of the table. Bracket 414 supporting an opposite end 422 of the set of stone sandwiches is horizontally adjustable in a direction 424 along a set of tracks 425 by a horizontal pump mechanism 430 (FIG. 17), analogous to that described above in connection with FIG. 2. Bracket 414 also has an edge 426 exactly aligned with an opposite edge 428** of the table.

An edge 432 of each disk is also precisely parallel to each edge 420, 428 of the table and is separated from an adjacent disk by a distance corresponding to the distance between the midpoints of the stone slabs in adjacent sandwiches. Laser alignment devices, such as that available from Edmund Scientific Corporation in Barrington, N.J., are used to align the disks with the stone sandwiches and to adjust the brackets relative to the edges of the table. As the bridge moves the rotating disks against the set of sandwiches, each disk splits a corresponding, aligned stone sandwich along a precise line exactly parallel to the length of the stone slab.

In FIGS. 19*a* through 19*h*, each stone sandwich 14 (only one sandwich 14 and one cutting disk 402 are shown for clarity) is first placed vertically against bracket 412 before moving bracket 414 firmly against an opposite side of the sandwich with the hydraulic pump mechanism. As the bridge is moved, disk 402 cuts through the stone slab 10 in the sandwich 14 to a depth determined by a radius of the disk and height of the disk above the table. The radius of each disk is limited by the strength (thickness and material) of the disk; a disk that is too large will flex and produce a warped cut in the stone sandwich.

The radius and position of the disk are typically chosen to cut slightly more than one half the width W of each stone sandwich, after which a metal T-shape 432 is inserted into the cut 436. The T-shape is shorter than the cut, so that a gap 438 is left between the T-shape and an end 440 of the cut.

After the T-shape is inserted, the adjustable bracket is moved away to release the sandwich. The sandwich is then rotated by 180 degrees to rest the T-shape on the table and to expose an uncut portion 442 of the stone slab to the disk. Each slab is now passed through the cutting machine a second time, allowing the disk to produce a second, identical cut 444 through portion 442 of the sandwich. Gap 438 allows disk 402 to complete the second cut without coming into contact with the T-shape. The second cut is thus aligned with and joins the first cut to completely split the sandwich into two stone laminated panels 18. The adjustable bracket is then moved away to release the stone panels.

After the sandwich is split, the T-shape prevents the two panels from collapsing against one another, in a manner analogous to the spacers described above, in connection with FIGS. 9 and 10. In addition, the T-shape maintains a precise vertical alignment of each side of the stone sandwich during cutting.

Alternatively, as seen in FIG. 20, stationary table 302*a* is replaced by table 86 supported by wheels moving along a track 88, in the manner described in connection with FIG. 4. The set of coaxial disk 402 are held stationary as the table moves the set of stone sandwiches 410 against the disks for cutting.

Referring to FIG. 21, a cutting and polishing machine 500 is constructed by placing sets of polishing disks 502, 504 behind the set of cutting disks 402 in the machine of FIG. 20. Each polishing disk has an abrasive surface 506, 508 on each side of the disk. Each disk in the first set of disks 502 has a coarse surface; each disk in the second set of disks 504 has a finer abrasive surface. To produce an even finer polish, additional sets of disks with progressively finer abrasive surfaces are added to the machine behind the second set of disks.

Each polishing disk is precisely aligned with a corresponding cutting disk, e.g. outermost disks 504*a*, 502*a* and 402*a* each have a diameter along axis 510; axis 510 is in turn aligned with stone slab 10*a* in outermost sandwich 14*a*. After the first cut 436 (FIG. 19*b*) is made by disks 402 in each stone sandwich, the table moves the stone sandwiches against the first set of polishing disks so that each polishing disk in the first set is inserted into the first cut in a sandwich aligned with the disk. Side surfaces 506, 508 of each disk thus come into contact with exposed stone surfaces 512, 514 (FIG. 19*b*) of the panels 18 (FIG. 19) on either side of the cut. As the disks rotate, they abrade and polish each exposed surface. The process repeats with the second set of polishing disks.

After each marble surface is polished, T-shape 430 (FIG. 19*c*) is inserted into each cut 436. Each sandwich is then rotated and passed through the machine again to split the sandwiches and polish the newly exposed surfaces 516, 518 (FIG. 19*h*) of stone in the panels. Precisely split, finely polished stone laminated panels result.

Referring to FIG. 22, the cutting machines produce stone laminated panels having a stone thickness t before polishing that is constant to within one millimeter. The cutting machines can thus very precisely split stone sandwiches to form extremely thin panels, e.g. panels having a stone thickness t of approximately two millimeters. These panels are extremely lightweight, and have an exposed stone surface that is almost exactly parallel to their backing. When mounted side by side on a level surface, the panels together form a smooth stone face with no visible gradation between panels.

Other embodiments are within the following claims. For example, the cutting machines described above are equally useful in splitting slabs made of other masonry material, for example concrete, or slabs of marble and granite without a backing. Concrete slabs with an inclined top surface, useful in construction applications, are cut by angling the diamond wire with respect to the horizontal top surface of the concrete slab by, for example, raising one large pulley (e.g pulley 40 in FIG. 2) above the level of the second pulley (e.g. pulley 40' in FIG. 2) supporting the wire.

The cutting machines described above are also used with stone slabs 10 cm thick or more. Dimensions of the slab are typically modified to match the size of the backing used. Instead of particle board or plastic honeycomb, the backing may be an aluminum honeycomb. When a plastic honeycomb is used, a sheet of aluminum may be glued to an exposed surface of the honeycomb on the stone sandwich to provide additional support. In the manufacturing process, the aluminum sheet (or sheets), the plastic honeycomb, and the stone slab are glued together in one step to produce the stone sandwich.

An electronic feedback circuit may be used to control the tension in the wire with the hydraulic pump. The hydraulic pump may be replaced by a mechanical or pneumatic device performing the same function. The 30 cm pulleys may be made even smaller in diameter to more accurately support the wire. The tables may be moved with a screw driven actuator instead of a spur gear, or with a cable and winch system that pulls the table through the diamond wire. In addition, another type of translational clutch mechanism can be used.

The spacer elements used to separate the cut panels can be a number of small spheres pumped into the gap between the panels, or a steel sheet supported horizontally that is slipped between the panels. Variable diameter sheaves on the large pulleys may be used together with a constant speed motor to adjust the speed of the diamond cutting wire. The height of one large pulley may be raised above the height of the second large pulley to produce an angled cut in the sandwich.

The cutting machines described above are also used to split sandwiches unevenly, to produce one relatively thin slab 18*a* and another relatively thick slab 18*b*, shown in FIG. 22. For example, a 3 cm thick marble slab may be cut by a 1 cm diamond wire into a laminated panel with 1 cm thick marble and another panel with marble 1.5 cm thick. This is done by, for example, adjusting the height of the pulleys supporting the wire to position the marble slab in the sandwich at an appropriate height against the wire.

In addition to the spring-loaded wheel exerting pressure on the stone sandwiches on a conveyor, as described above in connection with FIG. 12, a rough plastic facing is glued to the backing on one side of the stone sandwich. The rough facing provides enough friction against the belt to prevent the sandwich from slipping relative to the belt as it comes into contact with the diamond wire. The plastic facing is removed after the sandwiches are cut. Alternatively, an outer surface of an aluminum backing on the stone sandwich is abraded to provide the rough surface.

What is claimed is:

1. A method for making a non-vertical planar cut from one edge of a slab of masonry material, through the slab, to an opposite edge of the slab, comprising holding a moving cutting wire in a non-vertical position, aligning the slab with said one edge facing the cutting wire, and causing relative motion between the slab and the cutting wire so that the cutting wire moves completely through the slab in a non-vertical cutting plane.

2. The method of claim 1 wherein the non-vertical position is horizontal and the relative motion between the slab and the cutting wire makes a horizontal planar cut from one edge of the stone slab, through the slab, to an opposite edge of the slab.

3. The method of claim 1 wherein the step of causing relative motion between the slab and the cutting wire further comprises moving a support holding the slab against the cutting wire.

4. The method of claim 3 further comprising mounting the slab on the support and applying pressure on the mounted slab against the support after mounting the slab on the support.

5. The method of claim 1 further comprising causing relative motion of a succession of slabs consecutively against the cutting wire essentially without delay.

6. The method of claim 1 wherein causing relative motion comprises moving said cutting wire in the non-vertical cutting plane against the slab until the cut has been completed.

7. The method of claim 1 wherein the slab comprises stone with a backing disposed on each surface of the slab.

8. The method of claim 1 further comprising inserting a spacer inside the cut before the cut has been completed.

9. The method of claim 8 wherein the spacer comprises an inflatable seal that is inflated before the cut has been completed.

10. The method of claim 1 further comprising supporting the slab on a table with a back edge.

11. The method of claim 10 wherein the back edge comprises a pin inserted in a hole in the table.

12. A method for making non-vertical planar cuts in a series of slabs each made of masonry material, each cut extending from one edge of a slab, through the slab, to an opposite edge of the slab, comprising holding a moving cutting wire in a horizontal position, mounting a slab from the series horizontally on a support with said one edge of the slab facing the cutting wire, causing relative motion between the slab and the cutting wire, the slab and the cutting wire moving horizontally against each other until a cut has been completed in a horizontal cutting plane, and repeating the mounting step using an additional slab of the series and repeating the relative motion of the additional slab and the cutting wire until each slab has been cut.

13. Apparatus for making a non-vertical planar cut from one edge of a slab of masonry material, through the slab, to an opposite edge of the slab, comprising a loop of cutting wire having a linear cutting wire segment, two pulleys respectively supporting opposite ends of the cutting wire segment, and a rigid element arranged to apply respective opposing forces on the two pulleys, the element being positioned above the level of the cutting wire segment and below an opposite segment of the loop of cutting wire.

14. The apparatus of claim 13 wherein the length of the cutting wire segment is adjustable.

15. The apparatus of claim 13 wherein sheaves of the two pulleys are vertical.

16. The apparatus of claim 13 wherein a diameter of each of the pulleys is less than one meter.

17. The apparatus of claim 13 wherein each of the two pulleys is held by an adjustable support allowing a height of each pulley relative to the slab to be modified.

18. The apparatus of claim 13 further comprising two smaller pulleys which hold the cutting wire segment at both ends of the cutting wire segment so that the sheaves of the smaller pulleys and the cutting wire segment lie in a cutting plane.

19. The apparatus of claim 18 wherein the distance between the two smaller pulleys is adjustable.

20. The apparatus of claim 18 wherein the two smaller pulleys are horizontal.

21. The apparatus of claim 13 further comprising a hydraulic mechanism maintaining a desired level of tension on the cutting wire segment.

22. The apparatus of claim 13 further comprising a rail extending under the cutting wire segment and a table movable along the rail.

23. The apparatus of claim 22 wherein the table comprises a back edge for supporting a slab mounted on the table.

24. The apparatus of claim 23 wherein the back edge comprises a pin comprising a rigid material soft enough to be cut by the cutting wire segment, the pin being inserted in a hole in a top surface of the table.

25. The apparatus of claim 23 wherein the back edge is small enough to pass under the cutting wire segment upon movement of the table along the rail.

26. The apparatus of claim 22 further comprising a driver for moving the table along the rail.

27. The apparatus of claim 22 wherein the driver comprises a rotating spur gear locking onto a rack on a lower surface of the table.

28. The apparatus of claim 13 further comprising a moving conveyor belt disposed to move beneath the cutting wire for supporting and moving the slab against the cutting wire.

29. The apparatus of claim 28 further comprising a pressure element positioned to contact the slab when the slab is mounted on the conveyor belt, the pressure element holding the slab against the conveyor belt.

30. The apparatus of claim 13 wherein the rigid element comprises a rail transverse to the cutting wire segment of the cutting wire, said rigid element being movable along the rail to cause the cutting wire segment to move through a cutting plane above the rail against the slab.

31. Apparatus for making a non-vertical planar cut from one edge of a slab of masonry material, through the slab, to an opposite edge of the slab, comprising a loop of cutting wire having a linear cutting wire segment, a carriage for supporting the slab relatively moveably with respect to the cutting wire to describe a non-vertical cutting plane above and parallel to the carriage, two pulleys with coplanar, vertical side plates, said pulleys respectively supporting opposite ends of the cutting wire segment, a rigid element arranged to apply respective opposing forces on the two pulleys to maintain tension on the wire, the element being positioned above the level of the cutting wire segment but below an opposite segment of the loop of cutting wire, and two smaller pulleys with horizontal side plates lying in the cutting plane, each of the smaller pulleys supporting opposite ends of the cutting wire segment, the two smaller pulleys being movable in a direction along the cutting plane but being fixed in the cutting plane.

* * * * *